US006792744B2

(12) United States Patent
Feuerlohn et al.

(10) Patent No.: US 6,792,744 B2
(45) Date of Patent: Sep. 21, 2004

(54) SPINNING DEVICE FOR PRODUCING A SPUN YARN BY MEANS OF A CIRCULATING AIR FLOW

(75) Inventors: Helmut Feuerlohn, Mönchengladbach (DE); Thomas Weide, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 98 days.

(21) Appl. No.: 10/345,624

(22) Filed: Jan. 16, 2003

(65) Prior Publication Data

US 2003/0131579 A1 Jul. 17, 2003

(30) Foreign Application Priority Data

Jan. 17, 2002 (DE) ..... 102 01 577

(51) Int. Cl.[7] ..... D01H 4/02

(52) U.S. Cl. ..... 57/328; 57/333; 57/350; 57/400

(58) Field of Search ..... 57/315, 317, 318, 57/328–333, 350, 400, 403

(56) References Cited

U.S. PATENT DOCUMENTS 4,958,486 A 9/1990 Stahlecker ..... 57/261
5,159,806 A 11/1992 Mori et al. ..... 57/328
6,209,304 B1 4/2001 Feuerlohn et al. ..... 57/328
6,314,714 B1 11/2001 Feuerlohn et al. ..... 57/343
6,370,858 B1 * 4/2002 Mori ..... 57/6
6,564,538 B2 * 5/2003 Deno et al. ..... 57/328

FOREIGN PATENT DOCUMENTS

DE 38 17 222 A1 11/1989
DE 40 36 119 C2 5/1991
DE 199 26 492 A1 6/2000
DE 199 27 838 A1 12/2000

OTHER PUBLICATIONS

German Search Report.

* cited by examiner

*Primary Examiner*—Gary L. Welch
*Assistant Examiner*—Shaun R Hurley
(74) *Attorney, Agent, or Firm*—Kennedy Covington Lobdell & Hickman, LLP

(57) ABSTRACT

A spinning device for producing a spun yarn by a circulating air flow in a housing has an adjustment device (17) for controlling the angular position of the fiber ends wrapped around a spindle head, and in turn, the angular position of the fibers wrapped around the produced yarn, by adjusting a linear component of an air flow into the spinning device as a function of the yarn withdrawal speed, whereby a yarn is produced of a required yarn strength even during a spinning start phase in the process of making the spun yarn.

8 Claims, 7 Drawing Sheets

SPINNING DEVICE FOR PRODUCING A SPUN YARN BY MEANS OF A CIRCULATING AIR FLOW

CROSS-REFERENCES TO RELATED APPLICATIONS

This application claims the benefit of German patent application 102 01 577.5, filed Jan. 17, 2002, herein incorporated by reference.

BACKGROUND OF THE INVENTION

The present invention relates to a spinning device for producing a spun yarn by means of a circulating air flow.

A spinning device for producing a spun yarn by means of a circulating air flow is known from German Patent Publication DE 199 26 492 A1. A sliver to be spun is drawn into a nozzle body and passes a sliver guidance device. The sliver guidance device has sliver guide elements, which are spaced apart from each other and permit the free passage of a core fiber bundle. The sliver is subjected to an air flow circulating around the sliver at the inlet opening of a spindle. The free fiber ends of the sliver are wrapped around the conical spindle head by the circulating airflow at the inlet opening of the spindle. In the course of drawing the sliver into the hollow spindle, these fiber ends wrap themselves in a spiral shape to form wrapped fibers around the sliver, whereby a yarn is produced from the sliver and removed through the hollow spindle.

German Patent Publication DE 40 36 119 C2 also shows a device for producing a spun yarn by a circulating air flow by which free fiber ends of the sliver are wrapped around a conical spindle head at the inlet opening of the spindle by the circulating air flow. With this spinning device, the sliver guidance device is located inside the running fiber strand, so that the fibers of the sliver are arranged at the circumferential surface of the sliver guidance device.

Continuously increasing demands in regard to productivity and yarn properties are made on modern spinning frames. Such spinning devices, known from above-referenced. German Patent Publication DE 199 26 492 A1, or in another embodiment from above-referenced German Patent Publication DE 40 36 119 C2, are suitable for achieving high production speeds, along with good yarn properties. It is all the more bothersome if in the course of starting the processes at high withdrawal speeds, such as are employed during normal spinning operations, repetitions of the start of the spinning process are often made necessary because, at these high yarn speeds the spinning start process takes place relatively uncontrolled and with a greatly reduced assurance of a satisfactory spinning start.

It is known from rotor spinning to clearly lower the withdrawal speed during the spinning start process in comparison with the spinning operation in order to achieve a more easily controlled spinning start process and therefore greater spinning start assurance. However, if an attempt is made to utilize this type of operation from rotor spinning and to operate a circulating air flow spinning device at a lowered withdrawal speed of the yarn in the spinning start phase, a yarn is temporarily created thereby whose yarn strength could be unsatisfactory. Such yarn sections of reduced strength constitute undesired weak points. This increases the danger of yarn breaks and considerably reduces the interference-free processing of the yarn. In the least advantageous case a yarn break may occur already in the spinning start phase. This has very disadvantageous consequences with regard to the intention of achieving a good yarn quality along with high productivity when employing the air spinning method. It is therefore customary to perform the spinning start process at the high withdrawal speeds of the normal spinning operation and in the course of this start process to accept the disadvantages of frequent repetitions of the spinning start process.

The above described problems cannot be overcome by the known prior art, such as disclosed in German Patent Publications DE 199 26 492 A1 or in DE 40 36 119 C2.

SUMMARY OF THE INVENTION

It is accordingly an object of the present invention to further develop the above mentioned prior art to provide improved devices for producing a spun yarn employing a circulating air flow.

Basically, the spinning device of the present invention produces a spun yarn by a circulating air flow, and for this purpose comprises a housing having an inlet opening for receiving a sliver, at least one sliver guidance element arranged downstream of the inlet opening, a hollow spindle through which a formed yarn is withdrawn, the spindle having a conical spindle head, and openings in the area of the spindle inlet for injecting into the housing a circulating air flow comprised of a linear airflow component essentially in a yarn traveling direction and a twisting airflow component essentially in a helical orientation about the yarn for wrapping free fiber ends of the sliver helically around the spindle head to subsequently be wrapped around the yarn at an acute angle in respect to the yarn traveling direction as the yarn is drawn off through the spindle. In accordance with the present invention, an adjustment device is provided for adjusting at least the linear airflow component as a function of the withdrawal speed of the yarn and controlling a helical wrapping angle of the fiber ends around the spindle head and the acute angle of wrapping of the fibers around the yarn; and a control device is provided for controlling the adjustment device between a setting for the spinning start process and at least one setting for normal spinning operations. For example, the injector effect of air nozzles or the vacuum in the housing can contribute to forming the air flow. At least a part of the air flow in the yarn running direction can be formed by air entering the inlet opening of the housing together with the sliver.

In accordance with one embodiment of the present invention, the adjustment device includes a positionable cover for the inlet opening such that the position of the cover determines the cross section of the inlet opening. The greater the cross section of the inlet opening, the greater the amount of air entering the housing together with the sliver, and therefore the proportion of the linear component of the circulating air flow in the area of the spindle head. If the cross section is reduced, the amount of air is correspondingly reduced. The linear component of the air flow is advantageously set by controlling the cross section of at least one air inlet opening for this air flow. A control of the air drawn in through the inlet opening offers the advantage that no additional amount of air needs to be made available to be blown into the housing.

An alternative embodiment for setting the linear component of the air flow is provided by a bypass of the inlet opening of the fiber conduit in the housing, which is directed in the yarn traveling direction, and whose cross section can be adjusted by means of the adjustment device. In spinning frames with a plurality of work stations, considerable costs can be avoided by means of the mutual advantage of these embodiments by not having to provide additional amounts of air.

In a further alternative embodiment, the housing has at least one injection conduit, which is directed in the yarn traveling direction and is connected with the compressed air source. The adjustment device is equipped for setting the air pressure of the supplied air. In this manner, the adjustment of the linear component of the air flow occurs in a particularly simple and rapid manner through the regulation of the pressure of the air supplied by the compressed air source. In particular, no mechanical devices are required, whose function could be reduced or hampered by dust or flying fibers.

The linear component of the air flow is advantageously set in such a way that the angle at which the wrapped fibers have been placed around the withdrawn yarn lies in the range between 20° to 35°, preferably at 27°. It is possible to empirically determine how the adjustment device must be set in each individual case for achieving the greatest yarn strength possible, and to store the appropriate settings, for example in a data memory of a control device, for retrieval and use in connection with identical spinning parameters. For this purpose, the control device includes a data memory for storing yarn data and is connected to a line through which the yarn data can be input to the memory. The adjustment device can be controlled as a function of the yarn data.

The provision of a single drive mechanism for each spinning station makes it possible to be able to immediately perform every spinning start process at each spinning station in the manner in accordance with the invention independently of other spinning stations of the spinning frame. Downtimes are reduced in this way.

It is possible by means of the invention to prevent an impermissible drop of the yarn strength during the spinning start process, which is performed with a clearly reduced withdrawal speed in comparison with the normal spinning operation which ensues following the spinning start. The assured reliability of the spinning start process is increased. The tendency toward faults in the further processing of the yarn can be reduced. A high productivity, along with good yarn quality, can be achieved by means of the invention.

When using the device in accordance with the invention in connection with batch changes, it is possible in some cases to omit the exchange of the housing, or portions of the housing, for meeting the new yarn parameters.

Further details, features and advantages of the present invention will be explained and understood from the following description of preferred embodiments of the invention with reference to the accompanying drawing figures.

DESCRIPTION OF THE PREFERRED EMBODIMENT

Figure 1:
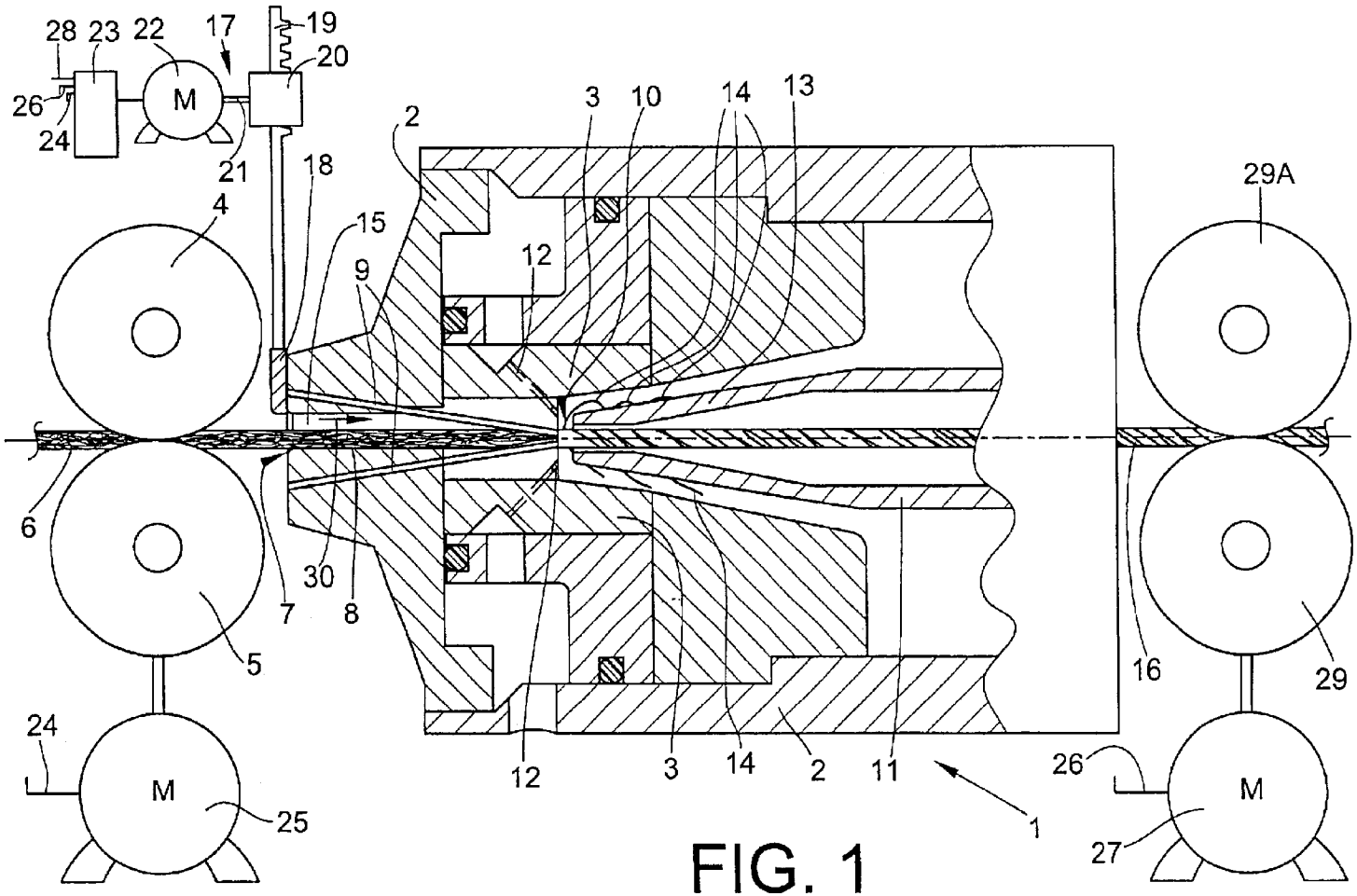
FIG. 1 is a partial schematic elevational view, partially in longitudinal section, of a spinning device in accordance with the present invention, depicting the device during the spinning start phase.

The spinning station 1 represented in a partial view in FIG. 1 has a housing 2, in which an air nozzle body 3 is mounted. A sliver 6 delivered by an arrangement of drafting rollers 4, 5 passes through a sliver conduit 8 and sliver guidance elements 9 and is conveyed to the inlet opening 10 of a hollow spindle 11. Air nozzles 12 formed in the nozzle body 3 blow air in the area of the inlet opening 10 of the spindle 11, forming an air flow circulating around the sliver 6 and the spindle head 13, which applies a twisting effect to the sliver 6. Free fiber ends 14 of the sliver 6 are wrapped around the sliver 6, as well as the spindle head 13. An air flow 30 is generated in the sliver conduit 8, or in the air gap 15 between the wall of the sliver conduit and the sliver 6 by the injector effect of the air blown in through the air nozzles 12, as well as by the sliver 6 entering the inlet opening 7 at high speed. The air flow 30 moves in the longitudinal direction of the sliver 6 toward the spindle head 13 and forms a linear component of the air flow circulating around the spindle 11. The yarn 16 formed from the sliver 6 is withdrawn through the spindle 11. In the process, the free fiber ends 14 wrapped around the spindle head 13 are taken along and wrapped around the yarn 16.

A further understanding of the basic structure and operation of the spinning station 1 can be taken from German Patent Publication DE 199 26 492 A1, or the corresponding U.S. Pat. No. 6,209,304, or from German Patent Publication DE 40 36 119 C2, or the corresponding U.S. Pat. No. 5,159,806, incorporated herein by reference.

A cover 18 which can be positioned by means of an adjustment device 17, is associated with the inlet opening 7. The adjustment device 17 acts via a toothed rack 19 on the cover 18. A gear wheel, not represented, in a gear housing 20 acts together with the toothed rack 19. The gear wheel is driven by an actuating motor 22 via an operative connection 21. The actuating motor 22 is controlled by a control device 23. The control device 23 controls a motor 25 through a line 24, as well as a motor 27 through a line 26. The control device 23 is connected through a line 28 with further elements, not represented for reasons of simplicity, of the spinning station and the spinning frame. The motor 25 drives the drafting rollers 4, 5, and the motor 27 drives the withdrawal rollers 29, 29A.

Figure 3:
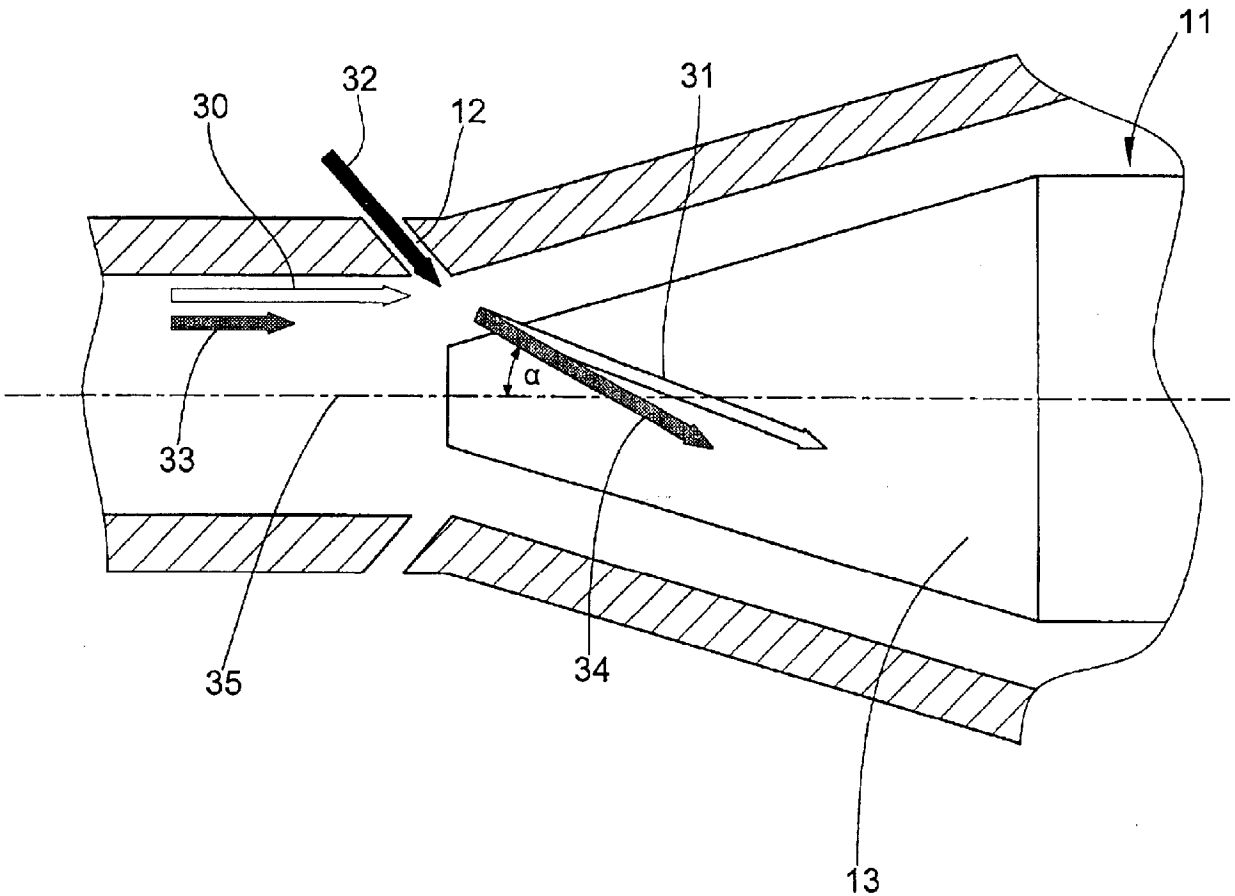
FIG. 3 is a simplified enlarged cross-sectional view of the spindle head of the present spinning device depicting a basic representation of the formation of the air flow in the area of the spindle head.

FIG. 1 shows the adjustment device 17 at the spinning station 1 during a spinning start phase of the spinning operation, with the cover 18 in a lifted position. It is possible in this manner to draw in a maximum amount of air through the inlet opening 7, and through the sliver conduit 8, which passes through the sliver conduit 8 in the form of an air flow 30 and which, as represented in FIG. 3, acts as a linear component of the circulating air flow 31. The circulating air flow 31 wraps the free fiber ends 14 around the spindle head 13.

Figure 2:
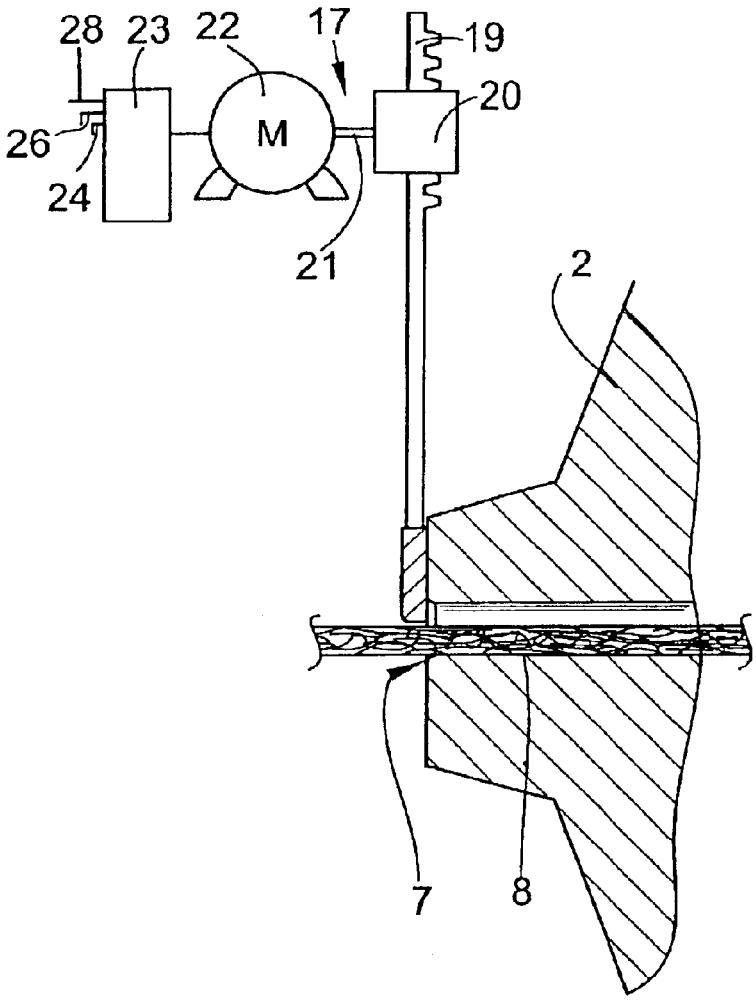
FIG. 2 is another schematic view, similar to that of FIG. 1, of the present spinning device but depicting only a smaller portion thereof during normal spinning operations.

FIG. 2 shows the spinning station during normal spinning operations. During normal spinning operations, the yarn traveling speed, i.e., the yarn withdrawal speed, is considerably higher in comparison with the spinning start phase. In this case, the cover 18 is in a lowered position. As a result, the air gap 15 has become narrower, and the amount of air drawn in through the inlet opening 7, and through the sliver conduit 8, is decreased in comparison with the setting represented in FIG. 1.

The principle of the formation of the air flow in the area of the spindle head 13 can be understood from FIG. 3. A stronger air flow 30, such as generated by the cover 18 in the raised position in accordance with the representation in FIG. 1 during the spinning start phase, combines with the air flow 32 comprised of air blown in through the air nozzle 12, to collectively form the air flow 31 circulating around the spindle head 13, both in respect to the strength as well as the direction of the air flow 31. The direction of the circulating air flow 31 defines the position of the free fiber ends 14 wrapped around the spindle head 13. In addition to indicating the air flow direction, the strength of the air flows 30, 31, 32, 33, 34 is indicated in FIG. 3 by the length of the arrows representing each of the air flows 30, 31, 32, 33, 34.

The air flow 33, which is created by the cover 18 in the lowered position in accordance with FIG. 2 during normal spinning operations, combines with the air flow 32 comprised of air blown in through the air nozzle 12, to form the air flow 34 circulating around the spindle head 13. The air flow 34 has a different direction than the air flow 31. This respective direction determines the position of the free fiber ends 14 during normal spinning operations. The air flow 34 forms an acute angle $\alpha$ with respect to a line parallel to the center axis 35 of the yarn, which is greater than the angle $\alpha$ formed by the air flow 31 with respect to the same line parallel to the center axis 35. Accordingly, the position of the free fiber ends 14 wrapped around the spindle head 13 is different during the spinning start phase than during normal spinning operations.

Figure 5:
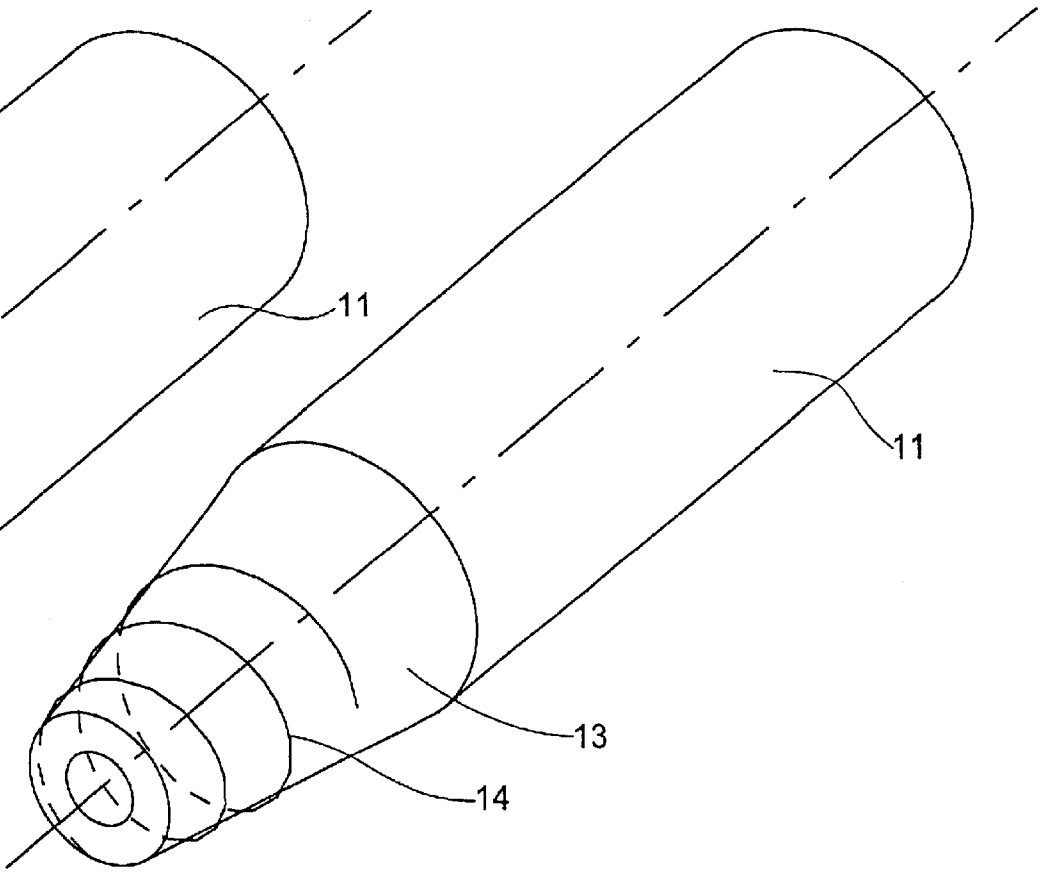
FIG. 5 is another perspective view of the spindle head of the present spinning device, depicting a greatly simplified basic representation of the position of the free fiber ends of the sliver wrapped around the spindle head during the normal spinning operation.
Figure 4:
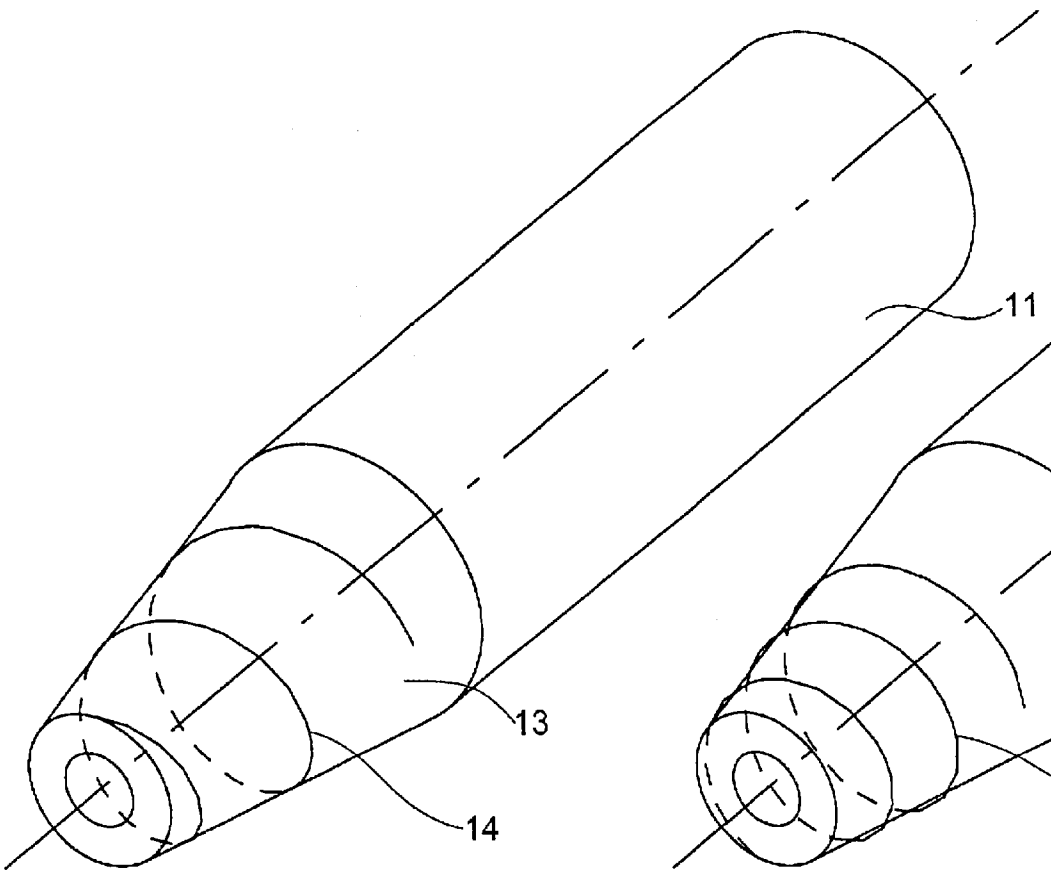
FIG. 4 is a perspective view of the spindle head of the present spinning device, depicting a greatly simplified basic representation of the position of the free fiber ends of the sliver wrapped around the spindle head during the spinning start phase.

The change in the position of the free fiber ends 14 on the spindle head 13 of the spindle 11 are shown in perspective views in FIGS. 4 and 5. The direction, or position, of the free fibers ends 14 during the spinning start phase, when the stronger air flow 30 is present, can be seen in FIG. 4, while the direction, or position, of the free fibers ends 14 during normal spinning operations when the air flow 33 is present can be seen in FIG. 5. The free fiber ends 14 wrapped around the spindle head 13 are represented longer than in actuality, for illustrative purposes of making the different positions clearer.

Figure 6:
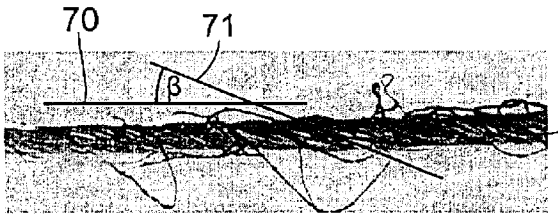
FIGS. 6 to 9 are actual photographs of yarn structures produced by the spinning device of the present invention at different settings and withdrawal speeds.

The yarn 36 represented in FIG. 6 was produced in accordance with the present invention at a withdrawal speed of 100 m/min and with a large opening during the spinning start phase with the cover 18 in the raised position represented in FIG. 1. The yarn 36 has wrapped-around fibers which predominantly lie at an angle $\beta$ of approximately 22° with a line parallel with the center axis of the yarn 36. The strength of the yarn 36 was measured to be 15.5 cN/tex. In FIG. 6, the angle $\beta$ is indicated by a horizontal line 70 and an obliquely extending line 71 representing the position of the wrapped-around fibers.

Figure 7:
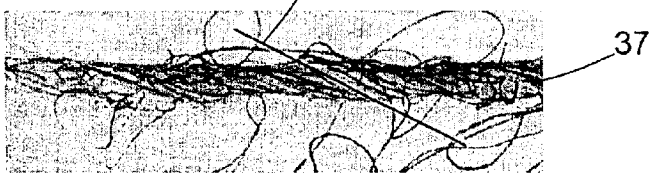
Figure 8:
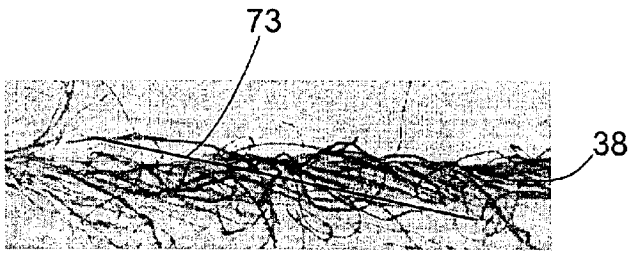
Figure 9:
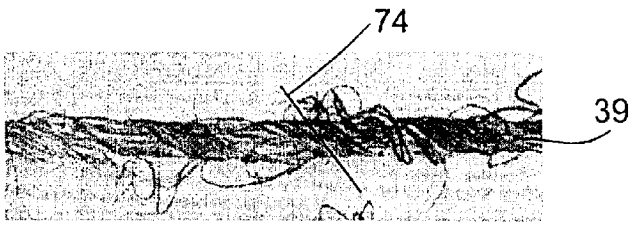

In each of FIGS. 7 to 9 the position of the wrapped-around fibers is similarly indicated by obliquely extending lines 72, 73 and 74.

The yarn 37 represented in FIG. 7 was produced in accordance with the present invention at a withdrawal speed of 300 m/min and with a narrow opening during normal spinning operations with the cover 18 in the lowered position represented in FIG. 2, has wrapped-around fibers which predominantly form an angle $\beta$ of approximately 27° with a line parallel with the center axis of the yarn 37. The strength of the yarn 37 was measured to be 13.4 cN/tex. The cross sectional area of the inlet opening formed for the air drawn into the housing 2 in the raised position of the cover 18 is called the large opening, and the cross sectional area of the inlet opening formed in the lower position of the cover 18 is called the narrow opening.

FIG. 8 shows a yarn 38 which was produced at a withdrawal speed of 300 m/min, instead of 100 m/min, with a large size of the opening unchanged from that used in producing the yarn of FIG. 6. The wrapped-around fibers form an angle $\beta$ of approximately 12°. The strength of the yarn 38 was measured to be 9.9 cN/tex.

FIG. 9 shows a yarn 39 which was produced at a withdrawal speed of 100 m/min, instead of 300 m/min, with a narrow size of the opening unchanged from that used in producing the yarn of FIG. 7. The wrapped-around fibers form an angle $\beta$ of approximately 52°. The strength of the yarn 39 was measured to be 10.7 cN/tex.

In each case, the clear decrease in yarn strength in comparison with yarn produced in accordance with the invention shows the result of yarn production in accordance with the known prior art where, for example, the withdrawal speed in the spinning start phase was lowered to 100 m/min in comparison with the withdrawal speed of 300 m/min during normal spinning operations. By dropping the withdrawal speed to a lower speed value it is intended for the spinning start process to run in a more controlled manner in order to increase the spinning start assurance in this manner. However, the reduced strength values of yarn produced in this manner do not satisfy the requirements and lead to the above mentioned defects, or disadvantages.

Figure 10:
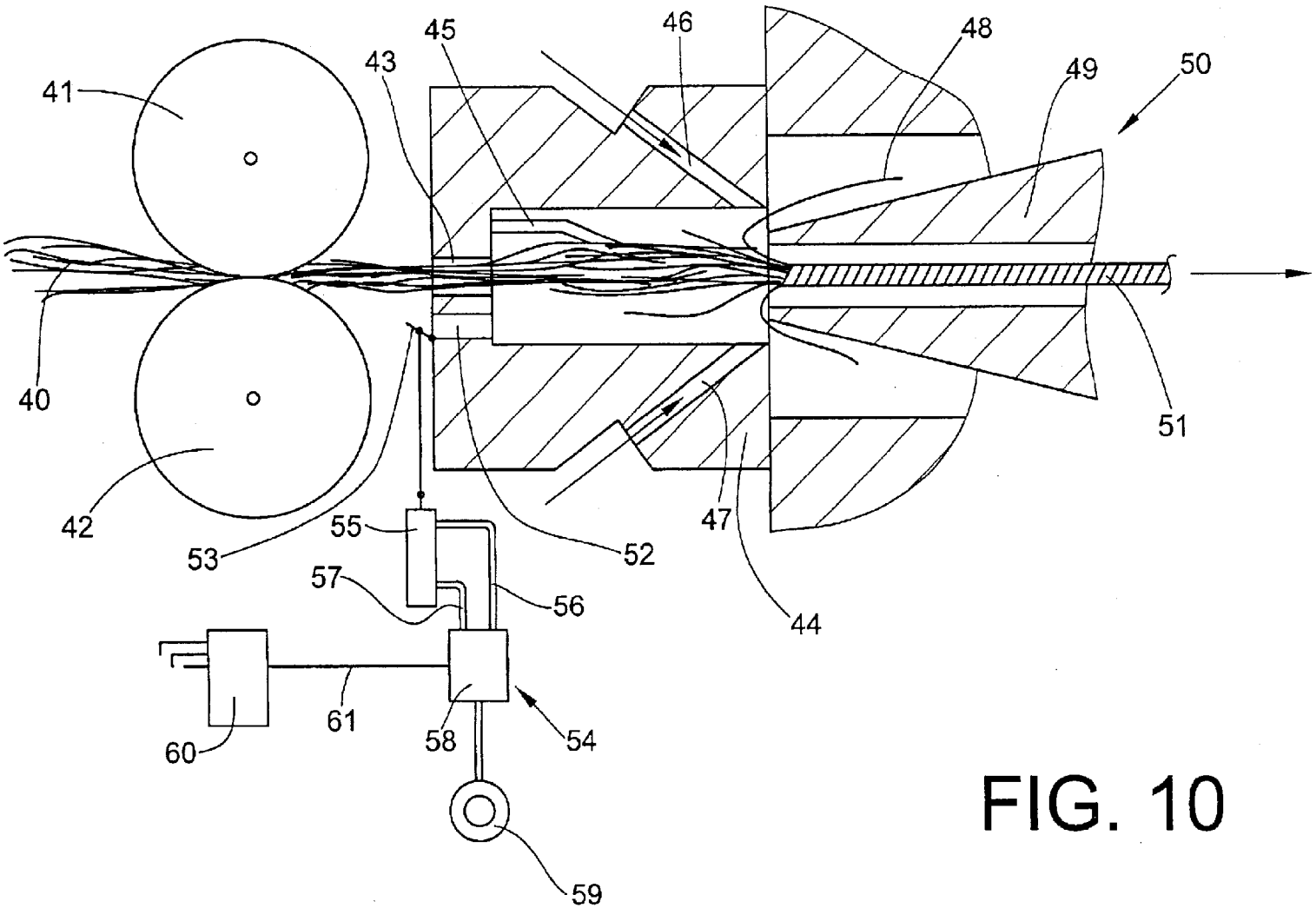
FIGS. 10 and 11 are schematic elevational views, partially in longitudinal section, of further spinning devices in accordance with the present invention.

FIG. 10 shows an alternative embodiment of the present invention. A sliver 40 is transported through the arrangement of drafting rollers 41, 42 and enters the housing 44 through the sliver conduit 43. In the housing 44, the sliver 40 is subjected to the action of a sliver guidance element 45 and a circulating air flow. The circulating air flow is generated by blowing air into the housing 44 through the air nozzles 46, 47. The circulating air flow wraps the free fiber ends 48 around the spindle head 49 of the hollow spindle 50. In turn, the free fiber ends 48 are placed around the yarn 51 in the form of wrapped-around fibers.

The housing 44 has a passage, embodied as a bypass 52 of the sliver conduit 43. The bypass 52 can be closed by means of a cover 53. The cover 53 can be pivoted by means of the adjustment device 54. The pivoting movement is generated with the aid of a lifting cylinder 55, which is pneumatically actuated via lines 56, 57. A switching arrangement 58 charges the lines 56 and 57 alternatively with compressed air supplied from a compressed air source 59. The switching arrangement 58 is actuated by a control device 60, with which it is connected via a line 61.

The bypass 52 is open in the representation of FIG. 10, so that air is drawn in through the sliver conduit 43, as well as through the bypass 52, and enters the circulating air flow as the linear component. This open setting of the bypass corresponds to the "large opening" setting of the sliver conduit 8 of the device represented in FIG. 1 as it is employed in the spinning start phase.

If the lifting cylinder 55 is charged with compressed air through the line 57, the piston of the lifting cylinder 55 moves upward in the representation in FIG. 10 until the cover 53 takes up the position indicated by dashed lines. The inflow of air through the bypass 52 is thereby stopped, and air is only drawn in through the sliver conduit 53. This setting corresponds to the "narrow opening" setting of the sliver conduit 8 in the device represented in FIG. 2, such as it is used in normal spinning operations.

Figure 11:
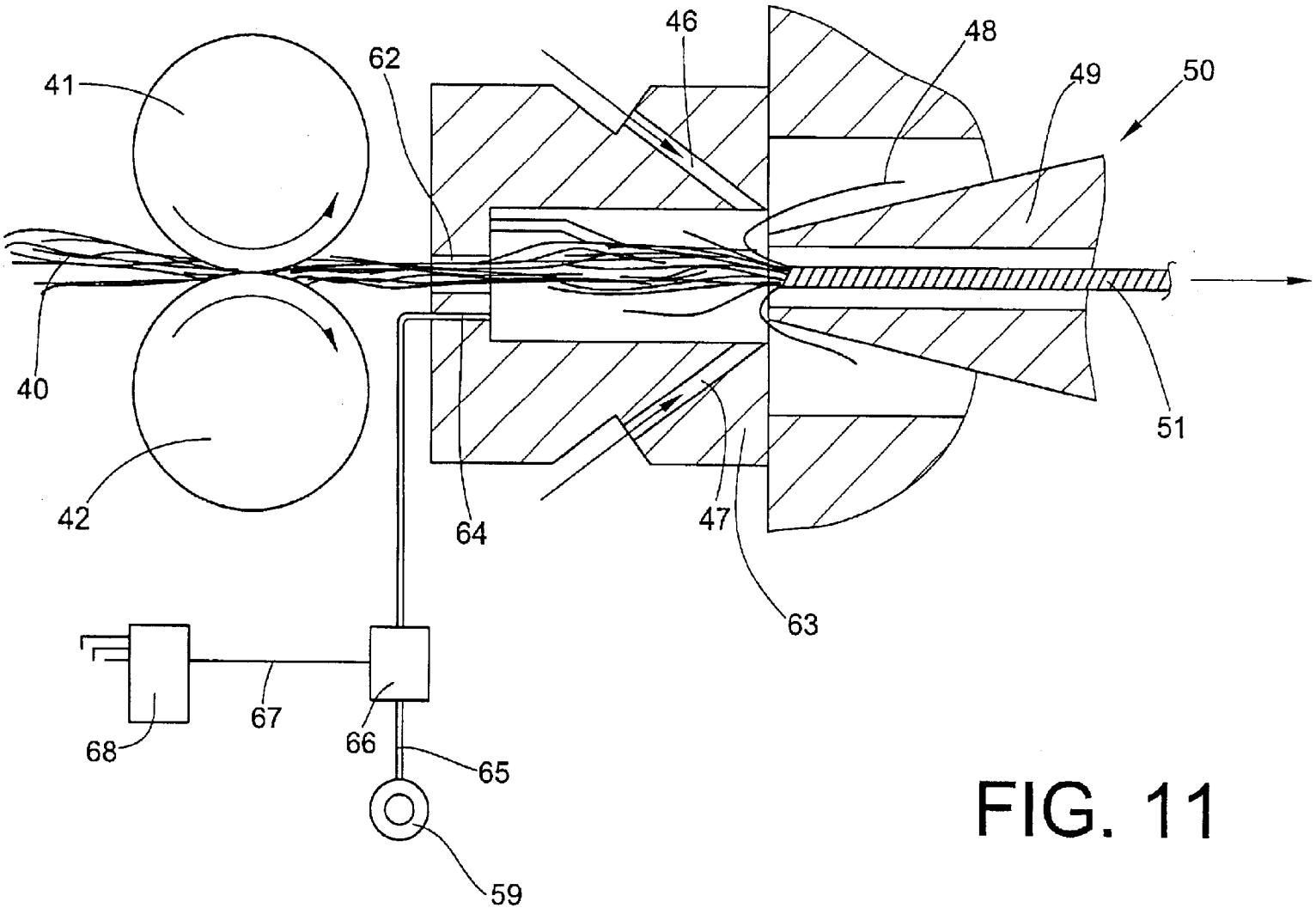

FIG. 11 shows another alternative embodiment of the invention. A sliver 40 runs through an arrangement of drafting rollers 41, 42 and enters a housing 63 through a sliver conduit 62, is subjected to the effects of a circulating air flow and is drawn off through a spindle 50. The circulating air flow wraps the free fiber ends 48 around the spindle head 49. When drawing off the yarn 51, the free fiber ends 48 are wrapped around the yarn 51 in the form of wrapped-around fibers. In contrast to the housing 44 represented in FIG. 10, the housing 63 has an air injection conduit 64 extending parallel with the sliver conduit 62. Compressed air is blown in through the injection conduit 64. For this purpose, the injection conduit 64 is connected through a line 65 with a compressed air source 65. The control of the air pressure is performed by means of an adjustment device 66. The adjustment device 66 is controlled through a line 67 by a control device 68. The compressed air is injected during the spinning start phase, wherein the air pressure is set such that the wrapped-around fibers lie at a desired angle β around the yarn 51, or that the desired yarn strength is achieved. The setting corresponds to a "large opening" setting of the sliver conduit 8 in the device represented in FIG. 1, such as is used in the spinning start phase. If, however, the compressed air supply is blocked, the setting corresponds to the "narrow opening" setting of the sliver conduit in the device as represented in FIG. 2, as it is employed in normal spinning operations.

For the spinning start process, the "large opening" setting is set, for example at a withdrawal speed of 100 m/min. Following the start of spinning, the withdrawal speed of the yarn 16, 51 is increased to, for example, 300 m/min for a normal spinning operation and the "narrow opening" setting is set. One setting of the adjustment device 17, 54, 66 is sufficient for normal spinning operations.

Alternatively to the examples as described, it is possible by means of a regulation of the air pressure to adapt the linear component of the air flow following the spinning start process in intermediate steps or continuously during the increase of the withdrawal speed in such a way that a desired high yarn strength is maintained during the respective increases. Accordingly, a continuous, or alternatively also stepped displacement of the positionable cover 18 can also take place during the increase in yarn withdrawal speed.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spinning device for producing a spun yarn by a circulating air flow, comprising a housing having an inlet opening for receiving a sliver, at least one sliver guidance element arranged downstream of the inlet opening, a hollow spindle through which a formed yarn is withdrawn, the spindle having a conical spindle head, and openings in the area of the spindle inlet for injecting into the housing a circulating air flow comprised of a linear airflow component essentially in a yarn traveling direction and a twisting airflow component essentially in a helical orientation about the yarn for wrapping free fiber ends of the sliver helically around the spindle head to subsequently be wrapped around the yarn at an acute angle in respect to the yarn traveling direction as the yarn is drawn off through the spindle; an adjustment device for adjusting at least the linear airflow component as a function of the withdrawal speed of the yarn and controlling a helical wrapping angle of the fiber ends around the spindle head and the acute angle of wrapping of the fibers around the yarn; and a control device for controlling the adjustment device between a setting for the spinning start process and at least one setting for normal spinning operations.

2. The spinning device in accordance with claim 1, wherein the adjustment device comprises a cover positionable relative to the inlet opening for adjusting the cross section of the inlet opening.

3. The spinning device in accordance with one of claim 1, wherein the housing further comprises at least one air injection conduit oriented in the yarn traveling direction, and the adjustment device is arranged for selective delivery of compressed air into the air injection conduit for setting the air pressure provided to the housing.

4. The spinning device in accordance with claim 1, wherein the housing has a bypass of the inlet opening oriented in the yarn traveling direction, and the adjustment device is arranged for adjusting the cross section of the bypass.

5. The spinning device in accordance with claim 1, wherein the acute angle β, at which the wrapped-around fibers are placed around the withdrawn yarn is in the range between 20° and approximately 35°.

6. The spinning device in accordance with claim 5, wherein the angle β is approximately 27°.

7. The spinning device in accordance with claim 1, wherein the control device includes a data memory for storing yarn data and is connected to an input line for receiving yarn data, the control device being arranged for controlling the adjustment device as a function of the yarn data.

8. The spinning device in accordance with claim 1, further comprising an individual drive mechanism for the spinning device.

* * * * *